US008428288B2

(12) United States Patent
Lim

(10) Patent No.: US 8,428,288 B2
(45) Date of Patent: Apr. 23, 2013

(54) EAR JACK FOR DETECTING EARPHONE PLUG

(75) Inventor: Ho-Yeong Lim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 212 days.

(21) Appl. No.: 12/966,292

(22) Filed: Dec. 13, 2010

(65) Prior Publication Data

US 2011/0170734 A1 Jul. 14, 2011

(30) Foreign Application Priority Data

Jan. 8, 2010 (KR) ..... 10-2010-0001990

(51) Int. Cl.
*H04R 25/00* (2006.01)

(52) U.S. Cl.
USPC ..... 381/384; 439/344; 439/668; 439/669

(58) Field of Classification Search ..... 381/384; 439/344, 668, 669, 188, 638
See application file for complete search history.

(56) References Cited

U.S. PATENT DOCUMENTS 6,835,080 B1 * 12/2004 Chang ..... 439/188
7,407,416 B1 * 8/2008 Rogers et al. ..... 439/669

* cited by examiner

*Primary Examiner* — Davetta W Goins
*Assistant Examiner* — Amir Etesam
(74) *Attorney, Agent, or Firm* — Jefferson IP Law, LLP

(57) ABSTRACT

An ear jack for detecting an earphone plug is provided. The ear jack includes a housing, a plurality of pins, a first detection part, a second detection part, and a controller. The housing includes a cavity for inserting terminals of the earphone plug. The plurality of pins are installed on an inner circumference surface of the housing and are in selective contact with a corresponding terminal of the earphone plug. The first detection part detects insertion of a first terminal of the earphone plug. The second detection part detects the insertion of the first terminal. The controller detects the insertion of the earphone plug when the first detection part and the second detection part both detect the insertion of the first terminal.

20 Claims, 5 Drawing Sheets

EAR JACK FOR DETECTING EARPHONE PLUG

PRIORITY

This application claims the benefit under 35 U.S.C. §119 (a) of a Korean patent application filed in the Korean Intellectual Property Office on Jan. 8, 2010 and assigned Serial No. 10-2010-0001990, the entire disclosure of which is hereby incorporated by reference.

BACKGROUND OF THE INVENTION

1. Field of the Invention

The present invention relates to an ear jack of an electronic device to which a wired earphone device or a wired earphone microphone device is applied. More particularly, the present invention relates to an ear jack for detecting an earphone plug, detecting erroneous insertion of the earphone plug and preventing an erroneous electronic device operation caused by a detected error of the earphone plug.

2. Description of the Related Art

As a result of the development of multimedia technologies, portable electronic devices having a variety of functions have been introduced. The devices include, for example, portable terminals, Moving Pictures Expert Group (MPEG)-1 or MPEG-2 Audio Layer-3 (MP3) players, Portable Multimedia Players (PMPs), and the like. The devices have a convergence function of performing one or more functions in combination.

In addition to a basic call function, a portable terminal also has a function of receiving a terrestrial broadcast (e.g., a terrestrial Digital Multimedia Broadcast (DMB)) and reproducing a music file or photographing and reproducing a moving picture in high definition.

When the portable terminal performs these various functions, the portable terminal makes supplementary use of an earphone device including an earphone plug inserted into an ear jack of the device. Also, in a case of the portable terminal, the earphone device includes the earphone plug at one end of a cable of a preset length and a pair of earphones at the other end of the cable. Also, the earphone device may include a microphone device on the cable and thus, may allow the portable terminal to perform a handsfree function during a telephone call.

The earphone plug usually uses four pole terminals. The terminals each are installed in an electrically insulated state. If the earphone plug is inserted into the ear jack, the terminals each are in contact with a corresponding pin installed in a corresponding position of the ear jack and perform a corresponding function.

For example, a 3.5 mm four-pole-terminal earphone plug electrically connects at its lowest first terminal with a pin for left speaker (SPK_L), at its upper second terminal with a pin for right speaker (SPK_R), at its upper third terminal with a pin for microphone (MIC), and at its upper fourth terminal with a pin for ground (GND), and performs a corresponding function.

An ear jack for housing the aforementioned earphone plug is constructed to correspondingly connect a plurality of corresponding terminals of the earphone plug to a plurality of pins installed in a different position within one housing. The construction causes a detection error problem based on inserting or uninserting the earphone plug from the ear jack. The error problem occurs because, despite the need that the terminal of the earphone plug should be matched and be in contact only with the pin of a different position of the ear jack, the terminal may be unmatched and in contact with a different pin.

To address this problem, the ear jack has at least one or more detection pins for detecting insertion or uninsertion of the earphone plug, in addition to the pins for detecting respective terminals of the earphone plug. The detection pins are installed to protrude within the ear jack, and are implemented to detect an opened or shorted state of the earphone plug being physically pushed when the earphone plug is inserted or uninserted from the ear jack.

More particularly, the recent portable terminals perform a multimedia operation of MP3 listening, and the like, a voice call, and a Frequency Modulation (FM) radio function through a 3.5 mm four-pole earphone. However, a detection error problem occurs in a case where an earphone plug is loosely inserted into the existing 3.5 mm four-pole ear jack or is slowly uninserted from the 3.5 mm four-pole ear jack. The detection error problem is a result of a restriction on the number of pins. In the convention 3.5 mm four-pole earphone the MIC terminal takes charge of several functions, including an ear microphone operation, an Analog to Digital Converter (ADC) verification, a TeleVision (TV)-OUT signal, and a call connection/disconnection key. Accordingly, in a case where the earphone plug is loosely inserted, the MIC terminal has an ambiguous value that is not HIGH because a contact point of the MIC terminal is unstable. More particularly, in a case where the earphone plug is slightly uninserted, a MIC pin drops to LOW and a call disconnection key operates even when a user does not press the call disconnection key.

Accordingly, for addressing a detection error occurring when a 3.5 mm four-pole earphone plug is slowly uninserted from the ear jack, there is a need to connect a detection signal to a General Purpose Input/Output (GPIO) to be used as an edge trigger or to add a voltage detector circuit. If the earphone plug is slowly uninserted from the ear jack, there may be an ambiguous voltage level signal applied. In this case, the GPIO fails to detect uninsertion of the earphone plug according to a detected LOW level of a transistor. For this reason, the ear jack uses a GPIO for detecting a change of a LOW/HIGH edge or adds a voltage detector circuit for comparing voltage levels such that only a constant LOW/HIGH value is always applied to the GPIO. Accordingly, the problem results from a part being added or a circuit restriction that occurs.

However, the two detection pins does not address the aforementioned detection failure where the detection pin has contact in a position far away from a last contact portion (i.e., the SPK_L). Also, there is a disadvantage in that, if a physically mobile terminal is protruded outside an extrusion, the terminal is easily damaged due to an external shock.

SUMMARY OF THE INVENTION

An aspect of the present invention is to address at least the above-mentioned problems and/or disadvantages and to provide at least the advantages described below. Accordingly, an aspect of the present invention is to provide an ear jack for detecting an earphone plug which includes two detection pins around one terminal of an earphone plug such that the two detection pins may be simultaneously opened or shorted, thereby preventing a detection error.

Another aspect of the present invention is to provide an ear jack for detecting an earphone plug which connects only a pull-up resistor and a voltage source without the addition of a separate external circuit addition, thereby detecting the earphone plug.

The above aspects are addressed by providing an ear jack for detecting an earphone plug.

According to an aspect of the present invention, an ear jack for detecting an earphone plug having terminals of at least three poles is provided. The ear jack includes a housing, a plurality of pins, a first detection part, a second detection part, and a controller. The housing includes a cavity for inserting the terminals of the earphone plug. The plurality of pins are installed on an inner circumference surface of the housing and are in selective contact with a corresponding terminal of the earphone plug. The first detection part detects insertion of a first terminal that is an end of the earphone plug. The second detection part detects the insertion of the first terminal The controller detects the insertion of the earphone plug when the first detection part and the second detection part both detect the insertion of the first terminal.

A portable terminal comprising an ear jack, the ear jack comprising a housing comprising a cavity for inserting terminals of at least three poles of an earphone plug, a plurality of pins installed on an inner circumference surface of the housing and being in selective contact with a corresponding terminal of the earphone plug; a first detection part for detecting insertion of a first terminal that is an end of the earphone plug; a second detection part for detecting the insertion of the first terminal; and a controller for detecting the insertion of the earphone plug when the first detection part and the second detection part both detect the insertion of the first terminal Other aspects, advantages, and salient features of the invention will become apparent to those skilled in the art from the following detailed description, which, taken in conjunction with the annexed drawings, discloses exemplary embodiments of the invention

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Figure 1:
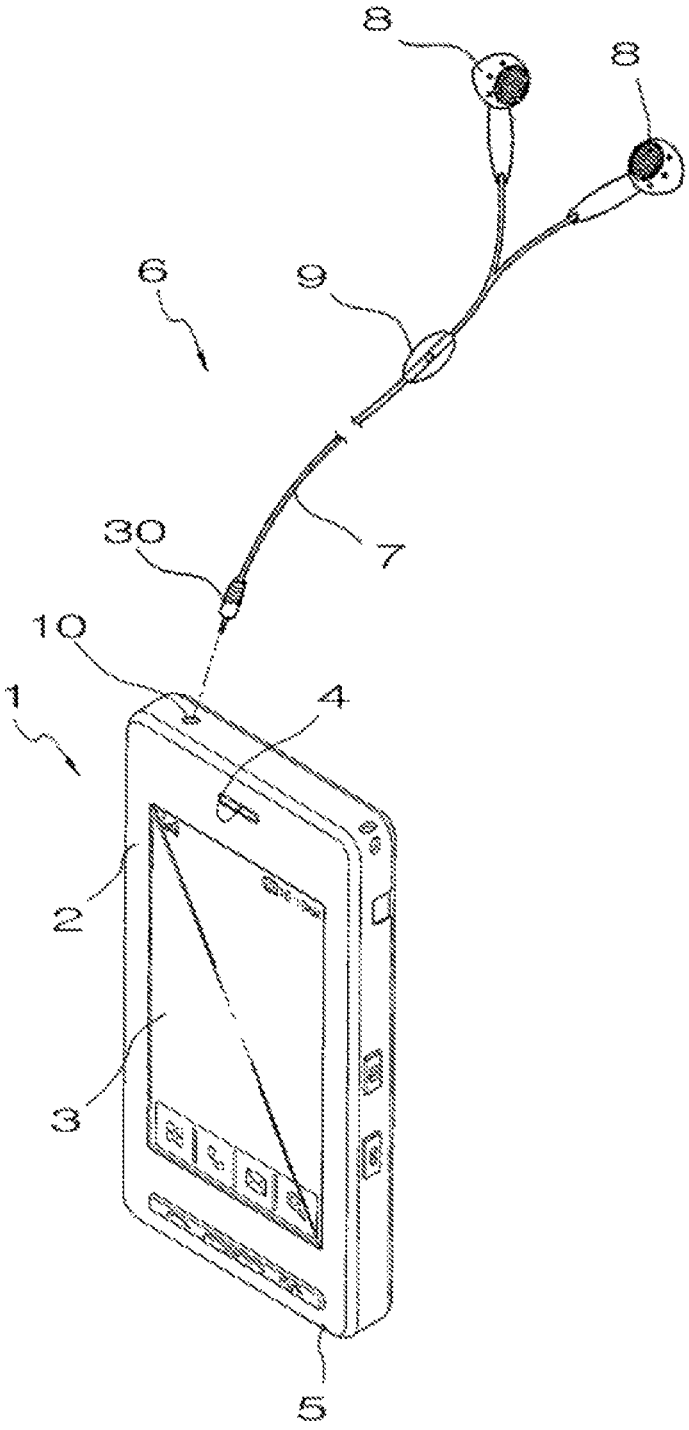
FIG. 1 is a perspective diagram illustrating a portable terminal and an ear microphone device applied to the portable terminal according to an exemplary embodiment of the present invention.

FIG. 1 is a perspective diagram illustrating a portable terminal and an ear microphone device applied to the portable terminal according to an exemplary embodiment of the present invention.

Referring to FIG. 1, an ear jack 10 for detecting an earphone plug 30 is applied to a portable terminal 1. However, it should be understood that the application to the portable terminal does not intend to limit the scope of the present invention. For example, the ear jack 10 is applicable to a variety of devices with an ear jack. Also, the present invention is equally applicable to any type of jack.

An ear microphone device 6 includes a cable 7 having a preset length, the earphone plug 30 connecting to one end of the cable 7, and a pair of earphones 8 branched and connected to the other end of the cable 7. Also, a microphone device (MIC) 9 includes a button for performing a variety of functions of a telephone call connection/disconnection, and the like of the portable terminal 1. The microphone device 9 is intervened in the cable 7.

The portable terminal 1 includes a display unit 3 installed in front of a body 2, a speaker 4 installed at the top of the display unit 3, and a microphone 5 installed at the bottom of the display unit 3. Also, the ear jack 10 is installed at the top of the body 2 of the portable terminal 1, and houses the earphone plug 30 of the ear microphone device 6.

The ear microphone device 6 may be applicable for listening to a music file and receiving and listening to a terrestrial broadcast using the display unit 3, in addition to a call hands-free function.

Figure 2:
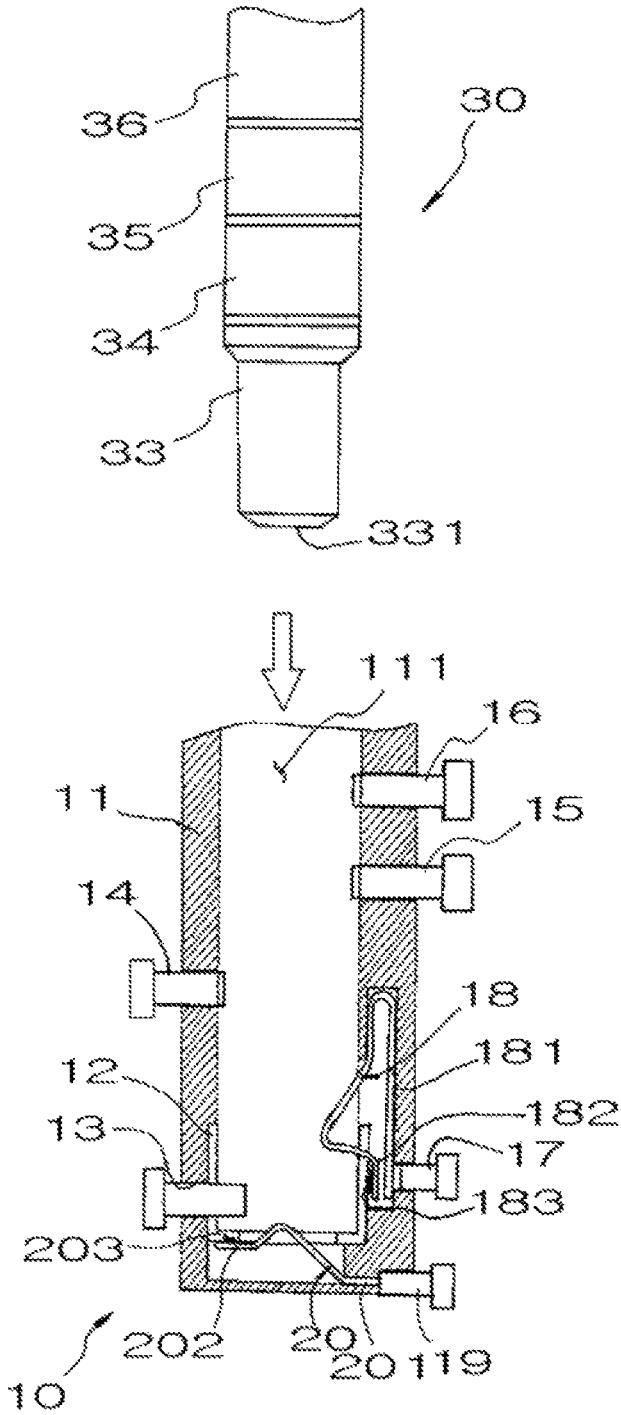
FIG. 2 is a sectional diagram of key parts of an earphone plug in which the earphone plug is uninserted from an ear jack according to an exemplary embodiment of the present invention.

FIG. 2 is a sectional diagram of key parts of an earphone plug in which the earphone plug is uninserted from an ear jack according to an exemplary embodiment of the present invention.

Figure 3:
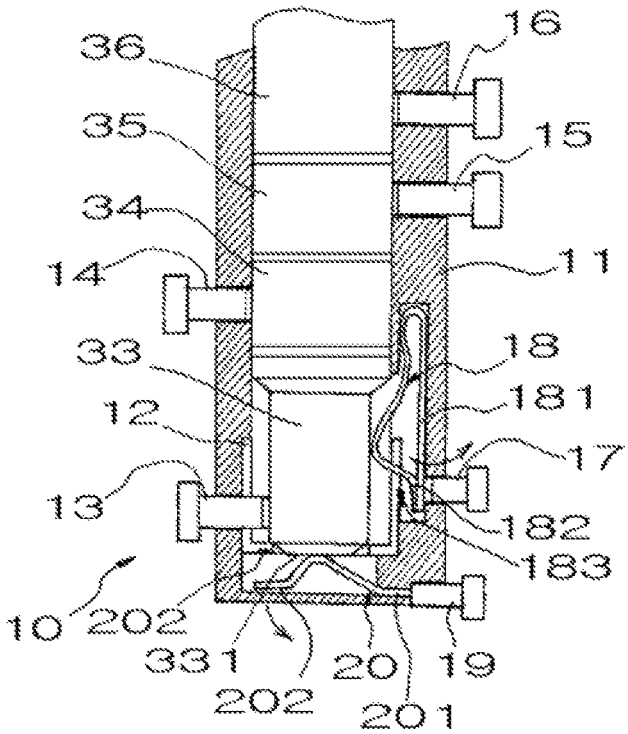
FIG. 3 is a sectional diagram of key parts of an earphone plug in which the earphone plug is inserted into an ear jack according to an exemplary embodiment of the present invention.

FIG. 3 is a sectional diagram of key parts of an earphone plug in which the earphone plug is inserted into the ear jack according to an exemplary embodiment of the present invention.

Referring to FIGS. 2 and 3, the ear jack 10 according to an exemplary embodiment of the present invention includes a housing 11 with a cavity 111 of a preset depth. The cavity 111 is formed to have a greater diameter than at least terminals 33, 34, 35, and 36 of the earphone plug 30. Also, a plug housing part 12 is further installed at a bottom of the cavity 111, and houses an end part 331 of the earphone plug 30. A plurality of pins 13, 14, 15, and 16 are formed to protrude from an inner circumference surface of the cavity 111. The plurality of pins 13, 14, 15, and 16 are installed in positions of different depths within the cavity 111. These positions may match to the terminals 33, 34, 35, and 36 of the earphone plug 30 inserted into the cavity 111.

The earphone plug 30 may electrically connect at its lowest first terminal 33 with the pin 13 for left speaker (SPK_L), connect at its upper second terminal 34 with the pin 14 for right speaker (SPK_R), connect at its upper third terminal 35 with the pin 15 for a MIC, and connect at its upper fourth terminal 36 with the pin 16 for GND.

Thereafter, a pair of detection pins 18 and 20 is installed to detect insertion or uninsertion of the earphone plug 30 according to an exemplary embodiment of the present invention. The pair of detection pins 18 and 20 may be installed in positions being in contact with the lowest first terminal 33 when the earphone plug 30 is fully inserted into the cavity 111.

The first detection pin 18 is installed to be in contact with an outer circumference surface of the first terminal 33. The second detection pin 20 is installed to be in contact with an end part 331 of the first terminal 33. In a case where the earphone plug 30 is not inserted into the cavity 111, the two detection pins 18 and 20 are in a state of contacting with preset contact points 183 and 203. When the earphone plug 30 is inserted into the cavity 111, the two detection pins 18 and 20 are pushed by both the outer circumference surface of the first terminal 33 and the end part 331 of the first terminal 33, thereby not being in contact with the contact point 183 and 203 while detecting the insertion of the earphone plug 30.

The first detection pin 18 includes a fixing end 181 electrically connecting with a detection terminal 17 of a device and a free end 182 partially protruding into the cavity 111 while being in selective contact with the contact point 183 and formed integrally with the fixing end 181. Also, the second detection pin 20 includes a fixing end 201 electrically connecting with another detection terminal 19 of the device and a free end 202 partially protruding into the cavity 111 while being in selective contact with the contact point 203.

Accordingly, when the earphone plug 30 is fully inserted into the cavity 111 of the ear jack 10, the first, second, third, and fourth terminals 33, 34, 35, and 36 push the first, second, third, and fourth pins 13, 14, 15, and 16 protruding from the inner circumference surface of the cavity 111 of the ear jack 10. At the same time, the first terminal 33 simultaneously pushes the first detection pin 18 and the second detection pin 20 while isolating the contact points 183 and 203. That is, the first detection pin 18 and the second detection pin 20 simultaneous detect opening and the uninsertion of the earphone plug 30.

A vertical distance between contact parts of the first detection pin 18 and the second detection pin 20 is set less than a vertical length of the first terminal 33 of the earphone plug 30. Therefore, once the first terminal 33 of the earphone plug 30 completely engages the first detection pin 18 and the second detection pin 20, one terminal being unmatched and being in electrical contact with a different pin can be prevented.

Figure 4:
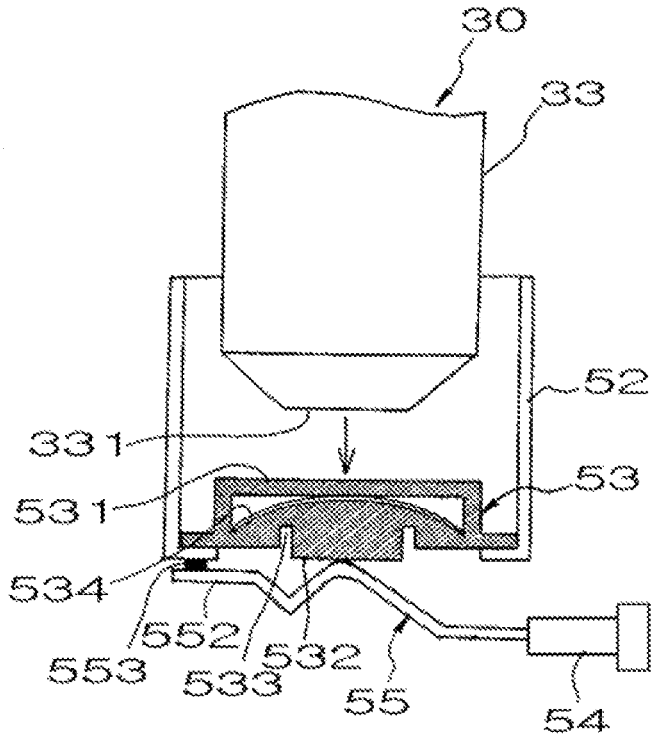
FIG. 4 is a sectional diagram of key parts of an earphone plug in which the earphone plug is uninserted from an ear jack according to an exemplary embodiment of the present invention.

FIG. 4 is a sectional diagram of key parts of an earphone plug in which the earphone plug is uninserted from an ear jack according to an exemplary embodiment of the present invention.

Figure 5:
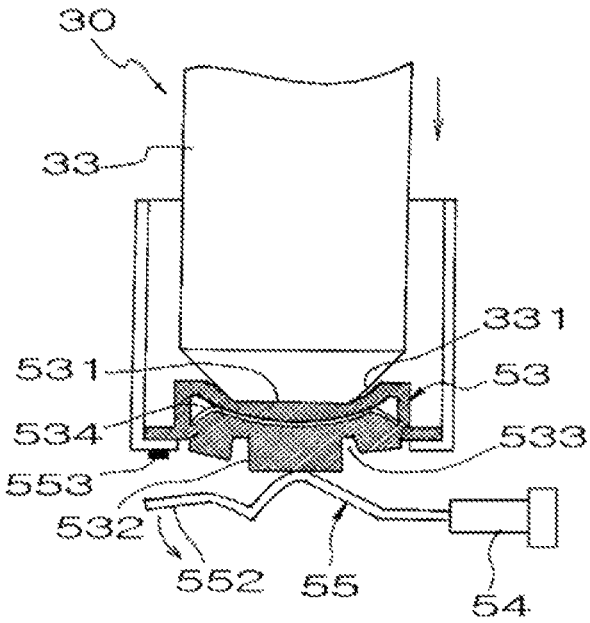
FIG. 5 is a sectional diagram of key parts of an earphone plug in which the earphone plug is inserted into an ear jack according to an exemplary embodiment of the present invention.

FIG. 5 is a sectional diagram of key parts of an earphone plug in which the earphone plug is inserted into an ear jack according to an exemplary embodiment of the present invention.

Referring to FIGS. 4 and 5, an earphone plug 30 and a first detection pin 18 are the same as those illustrated in FIGS. 2 and 3. However, the difference in the earphone plug 30 and the first detection pin 18 is a construction for selectively isolating a second detection pin 55 from a contact point 553.

Referring to FIGS. 4 and 5, the second detection pin 55 is not in direct contact with an end part 331 of a first terminal 33, but may be have contact through a separate medium. The separate medium assists an elastic force of the second detection pin 55 itself and helps with a more smooth insertion and uninsertion of the earphone plug 30.

The separate medium may be an actuator 53 including a metal dome 534 therein. The actuator 53 is of silicon or rubber material having a self elastic force, and is installed to be supported by a plug housing part 52. The actuator 53 has a terminal contact part 531 installed at its top, and has a contact protrusion 532 installed at its bottom end and may be in contact with a free end 552 of the second detection pin 55. A groove 533 is provided around the contact protrusion 532 such that the contact protrusion 532 may smoothly press the free end 552 when the contact protrusion 532 is pushed by the end part 331 of the terminal 33. If the contact protrusion 532 is of a circular shape in its section, the groove 533 may be of a circular shape surrounding the contact protrusion 531. The actuator 53 may be formed of elastic material such as silicon and the like. The metal dome 534 may be installed using a method of insert-molding into the actuator 53 and the like.

Accordingly, as illustrated in FIG. 5, if the earphone plug 30 is fully inserted into the cavity 111 (illustrated in FIG. 2), the first detection pin 18 (illustrated in FIG. 2) will be isolated from the contact point 183 (illustrated in FIG. 2). Also, the end part 331 of the first terminal 33 presses the terminal contact part 531 of the actuator 53 downwards. At this time, the metal dome 534 will be distorted downwards holding a preset restoration force. As a result, the contact protrusion 532 of the actuator 53 presses the free end 552 of the second detection pin 55 downwards. Therefore, the free end 552 is isolated from the contact point 553, a detection terminal 54 detects the isolation, and a controller of a device recognizes that the earphone plug 30 is fully inserted.

On the other hand, if the earphone plug 30 is uninserted from the cavity 111 (illustrated in FIG. 2), the actuator 53 will be restored to an original form as illustrated in FIG. 4 based on the restoration force of the metal dome 534 and an elastic force of its material itself.

An ear jack according to an exemplary embodiment of the present invention has an effect of efficiently detecting insertion or uninsertion of an earphone plug by a pair of detection pins installed in equal positions, and detecting the insertion or uninsertion of the earphone plug by only a simple mechanical construction.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An ear jack for detecting an earphone plug comprising terminals of at least three poles, the ear jack comprising:

a housing comprising a cavity for inserting the terminals of the earphone plug;

a plurality of pins installed on an inner circumference surface of the housing and being in selective contact with a corresponding terminal of the earphone plug;

a first detection part for detecting an insertion of a first terminal that is an end of the earphone plug;

a second detection part for detecting the insertion of the first terminal, wherein the second detection part comprises a plate spring installed to be pressed upwards in a bottom surface of the housing so as to provide an electrical connection with the controller that is controlled based on the insertion of the first terminal;

a controller for detecting the insertion of the earphone plug when the first detection part and the second detection part both detect the insertion of the first terminal; and an actuator installed between the second detection part and an end part of the earphone plug such that the actuator is pressed by the end part, and the actuator presses the plate spring to electrically connect and disconnect the plate spring from the controller.

2. The ear jack of claim 1, wherein the first detection part comprises a plate spring protrusively installed in a side surface of the housing and detecting that the spring is pushed by a side surface of the first terminal, and is at least one of opened and shorted with a preset contact point electrically connecting with the controller.

3. The ear jack of claim 2, wherein the plate spring is pushed by an end part of the first terminal and is at least one of opened and shorted with a preset contact point that electrically connects the second detection part with the controller.

4. The ear jack of claim 3, wherein the second detection part comprises a metallic plate spring including a free end and a fixing end formed integrally with the free end, the free end partially protruding inside the housing and being in selective contact at its end with a preset contact point, and the fixing end being fixed to a detection terminal connecting with the controller.

5. The ear jack of claim 3, wherein the actuator presses the plate spring to isolate the plate spring from the contact point.

6. The ear jack of claim 5, wherein the actuator is installed to be fixed to an inner side of a bottom surface of the housing and be supported by an elastic force of a metal dome molded inside.

7. The ear jack of claim 6, further comprising:

a contact protrusion comprising a groove adjacent thereto, wherein the contact protrusion is formed to protrude from the bottom of the actuator, and presses the plate spring downwards when the earphone plug is inserted into the housing.

8. The ear jack of claim 7, wherein, when the earphone plug is uninserted from the housing, the actuator is restored to an original state by the metal dome.

9. The ear jack of claim 8, wherein the actuator is formed of at least one of silicon and elastic rubber material, and the metal dome is insert-molded inside the actuator.

10. The ear jack of claim 9, wherein the first detection part and the second detection part include a vertical distance between thereof that is constructed to be shorter than a vertical length of the first terminal.

11. A portable terminal comprising an ear jack, the ear jack comprising:

a housing comprising a cavity for inserting terminals of at least three poles of an earphone plug;

a plurality of pins installed on an inner circumference surface of the housing and being in selective contact with a corresponding terminal of the earphone plug;

a first detection part for detecting an insertion of a first terminal that is an end of the earphone plug;

a second detection part for detecting the insertion of the first terminal, wherein the second detection part comprises a plate spring installed to be pressed upwards in a bottom surface of the housing so as to provide an electrical connection with the controller that is controlled based on the insertion of the first terminal;

a controller for detecting the insertion of the earphone plug when the first detection part and the second detection part both detect the insertion of the first terminal; and an actuator installed between the second detection part and an end part of the earphone plug such that the actuator is pressed by the end part, and the actuator presses the plate spring to electrically connect and disconnect the plate spring from the controller.

12. The portable terminal of claim 11, wherein the first detection part comprises a plate spring protrusively installed in a side surface of the housing and detecting that the spring is pushed by a side surface of the first terminal, and is at least one of opened and shorted with a preset contact point electrically connecting with the controller.

13. The portable terminal of claim 12, wherein the plate spring is pushed by an end part of the first terminal and is at least one of opened and shorted with a preset contact point that electrically connects the second detection part with the controller.

14. The portable terminal of claim 13, wherein the second detection part comprises a metallic plate spring including a free end and a fixing end formed integrally with the free end, the free end partially protruding inside the housing and being in selective contact at its end with a preset contact point, and the fixing end being fixed to a detection terminal connecting with the controller.

15. The portable terminal of claim 13, wherein the actuator presses the plate spring to isolate the plate spring from the contact point.

16. The portable terminal of claim 15, wherein the actuator is installed to be fixed to an inner side of a bottom surface of the housing and be supported by an elastic force of a metal dome molded inside.

17. The portable terminal of claim 16, further comprising:

a contact protrusion comprising a groove adjacent thereto, wherein the contact protrusion is formed to protrude from the bottom of the actuator, and presses the plate spring downwards when the earphone plug is inserted into the housing.

18. The portable terminal of claim 17, wherein, when the earphone plug is uninserted from the housing, the actuator is restored to an original state by the metal dome.

19. The portable terminal of claim 18, wherein the actuator is formed of at least one of silicon and elastic rubber material, and the metal dome is insert-molded inside the actuator.

20. The portable terminal of claim 19, wherein the first detection part and the second detection part include a vertical distance between thereof that is constructed to be shorter than a vertical length of the first terminal.

* * * * *